US005525048A

United States Patent [19]

Tuckey

[11] Patent Number: 5,525,048

[45] Date of Patent: Jun. 11, 1996

[54] CANTILEVER ARMATURE MOUNT FOR FUEL PUMPS

[75] Inventor: Charles H. Tuckey, Cass City, Mich.

[73] Assignee: Walbro Corporation, Cass City, Mich.

[21] Appl. No.: 388,246

[22] Filed: Feb. 14, 1995

Related U.S. Application Data

[63] Continuation-in-part of Ser. No. 167,743, Dec. 15, 1993, Pat. No. 5,411,376.

[51] Int. Cl.[6] ..... F04B 17/00; F04B 39/06

[52] U.S. Cl. ..... 417/423.15; 417/423.7; 417/366

[58] Field of Search ..... 417/366, 410.4, 417/423.7, 423.15, 423.8, 423.12; 418/177, 166

[56] References Cited

U.S. PATENT DOCUMENTS

| | | | |
|---|---|---|---|
| 4,134,712 | 1/1979 | Kemmner et al. | 417/423.12 |
| 4,352,641 | 10/1982 | Tuckey | 417/283 |
| 4,401,416 | 8/1983 | Tuckey | 417/283 |
| 4,500,270 | 2/1985 | Tuckey | 418/171 |
| 4,540,354 | 9/1985 | Tuckey | 418/171 |
| 4,596,519 | 6/1986 | Tuckey | 418/171 |
| 4,692,092 | 9/1987 | Matsuda et al. | 417/366 |
| 4,697,995 | 10/1987 | Tuckey | 418/15 |
| 4,768,931 | 9/1988 | Iwai et al. | 417/366 |
| 4,789,308 | 12/1988 | Tuckey | 417/366 |
| 4,948,346 | 8/1990 | Tuckey | 417/312 |
| 5,006,048 | 4/1991 | Jow | 417/366 |
| 5,039,284 | 8/1991 | Talaski | 417/366 |
| 5,088,900 | 2/1992 | Yoshioka et al. | 417/366 |
| 5,120,201 | 6/1992 | Tuckey et al. | 417/366 |
| 5,122,039 | 6/1992 | Tuckey | 417/366 |
| 5,131,822 | 7/1992 | Yamamoto et al. | 417/366 |
| 5,257,916 | 11/1993 | Tuckey | 417/423 |
| 5,338,165 | 8/1994 | Brockner et al. | 417/366 |
| 5,393,206 | 2/1995 | Roth et al. | 417/423.12 |
| 5,411,376 | 5/1995 | Fournier et al. | 417/312 |
| 5,413,468 | 5/1995 | Tuckey | 417/366 |

*Primary Examiner*—Peter Korytnyk
*Attorney, Agent, or Firm*—Barnes, Kisselle, Raisch, Choate, Whittemore & Hulbert

[57] ABSTRACT

A fuel pump for automotive vehicles which has a pump housing and an outlet housing at the respective ends of a pump motor with an armature and a stator. A drive and support shaft at one end of the armature is journaled for rotation in a bearing in the pump housing. The shaft and bearing at the one end of the armature serves as the only bearing and support for the armature in a cantilever relation to the pump housing.

12 Claims, 2 Drawing Sheets

CANTILEVER ARMATURE MOUNT FOR FUEL PUMPS

REFERENCE TO CO-PENDING APPLICATION

This application is a continuation-in-part of U.S. patent application Ser. No. 08/167,743 filed on Dec. 15, 1993 and now U.S. Pat. No. 5,411,376.

FIELD OF INVENTION

This invention relates to automotive fuel systems and more particularly to electrically operated fuel pumps for internal combustion engines.

BACKGROUND OF THE INVENTION

In the design of an automotive fuel pump, the main objectives have been to reduce noise, reduce cost, achieve excellent alignment, increase efficiency, improve performance and provide a long in service life for a pump that is contained in a fuel tank. In U.S. Pat. No. 4,352,641 issued on Oct. 5, 1982, a pump is disclosed having an armature shaft projecting from each end of the armature. One end of the shaft is mounted for rotation in a cam ring and the other end is mounted in a spherical ball located in a conical seat. The cam ring can rock in the housing and the ball mount will allow the shaft to find an aligned position with no flexing or bending of the shaft. In a later patent, U.S. Pat. No. 4,401,416 issued on Aug. 30, 1983, the armature shaft at the inlet end of the pump is mounted in a spherical ball and the other end is journalled in an outlet housing. In U.S. Pat. No. 4,948,346 issued on Aug. 14, 1990, the armature, with a shaft extending at each end, is floatingly mounted between a spring drive at one end and between flexible fingers at the other end to absorb any misalignment or unbalance.

SUMMARY OF THE INVENTION

An electric fuel pump with a rotating armature with a central drive shaft which is journalled for rotation at only one end of the armature. Preferably this shaft also mounts and journals for rotation the rotor of the pump. Preferably, the armature is journalled for rotation in the pump housing and the other end of the armature is free to float when the motor is operating. Preferably, the commutator and the outlet housing of the pump assembly are adjacent the other end of the armature. This construction can be utilized to drive regenerative, turbine, gear rotor and positive displacement types of pumps.

Objects, features and advantages of this invention are to provide an electric fuel pump which substantially reduces noise and vibration, provides a stable armature and pump rotor mount, can utilize various types of pumps, simplifies manufacture and assembly, reduces production costs, and is rugged, durable of simplified design and in service has a long useful life.

BRIEF DESCRIPTION OF THE DRAWINGS

These and other objects, features and advantages of the invention will be apparent from the following detailed description of the preferred embodiments and best mode presently contemplated for the invention, as well as in the appended claims, and accompanying drawings, in which:

DETAILED DESCRIPTION

Figure 1:
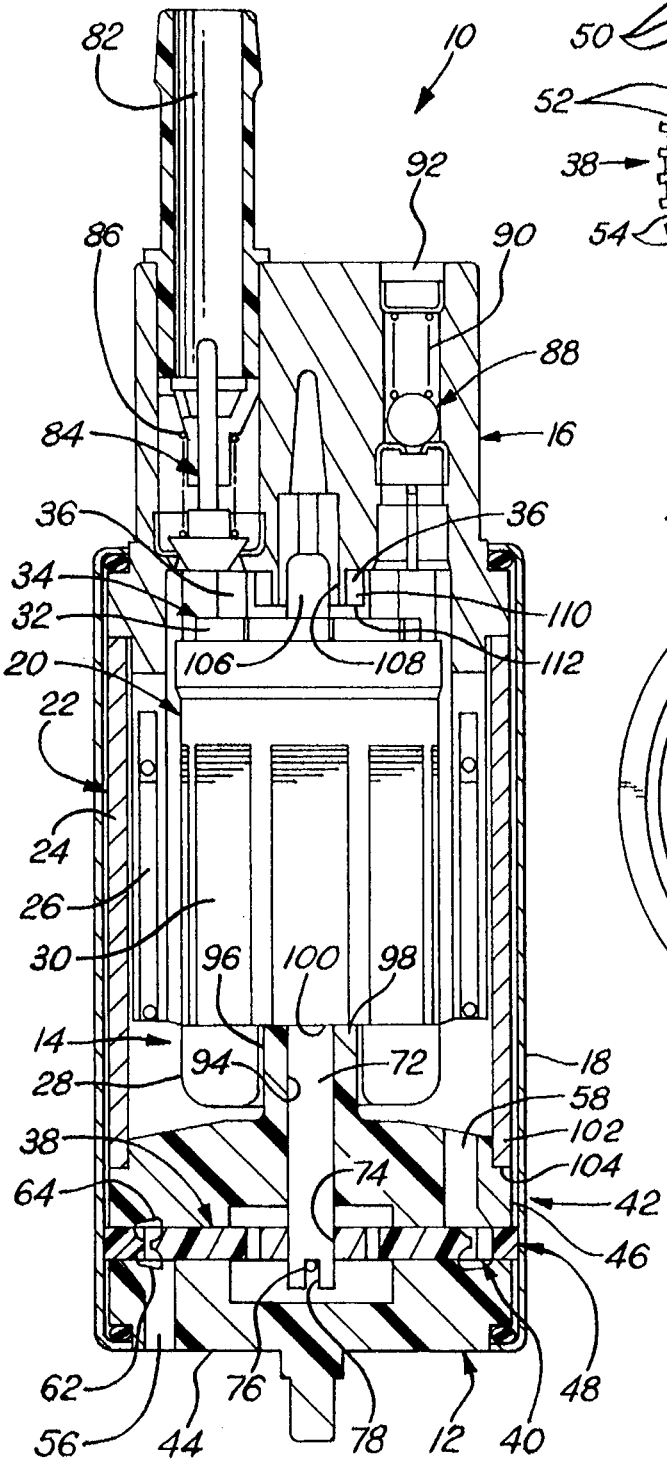
FIG. 1 is a longitudinal section of an electric fuel pump illustrating a cantilever mount of the armature and pump impeller.

Referring in more detail to the drawings, FIGS. 1–4 illustrate an electric fuel pump assembly 10 embodying this invention which is typically disposed in a fuel tank of an automotive vehicle for supplying liquid fuel under pressure to the vehicle engine. The pump assembly has a turbine pump 12 driven by an electric motor 14 and an end cap housing 16 received in a tubular case 18. The motor has an armature 20 received in a stator 22 with a cylindrical flux ring 24 and permanent magnets 26. The armature has electric coils 28 received in a core 30 and electrically connected to the segments 32 of a commutator 34, mounted on one end of the armature. The commutator cooperates with brushes 36 slidably mounted in the end cap housing 16, yieldably biased by springs into engagement with the commutator and electrically connected to a suitable source of power, such as a vehicle battery or electrical system (not shown), to operate the motor.

Figure 2:
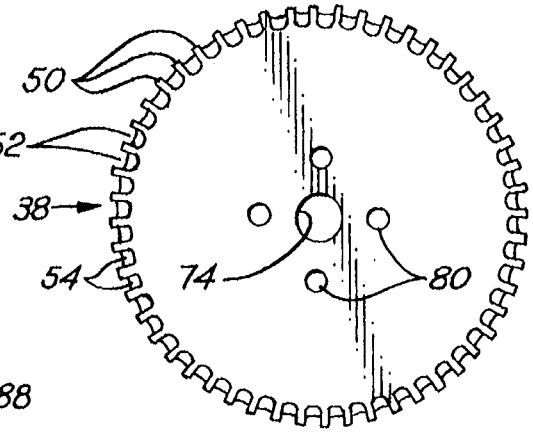
FIG. 2 is a plan view of the pump impeller.

The pump has an impeller 38 surrounded by an annular channel 40 defined by the cooperation of a pump housing 42 with an inlet end cap 44, an outlet cap 46 and a ring 48 received between them and encircling the impeller. As shown in FIGS. 1 and 2, the impeller 38 is a flat disc with radially and axially extending ribs 50 uniformly circumferentially spaced around its periphery and defining vanes 52 between them on both faces of the impeller. Preferably, an annular rib 54 extends circumferentially between the radially projecting ribs 50 and terminates radially inward of the periphery of the impeller 38 to define partially closed vanes 52 on both faces of the impeller.

Figure 3:
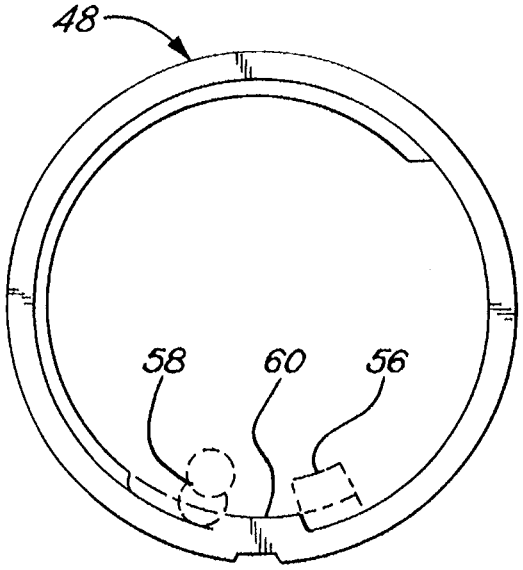
FIG. 3 is an elevation of an outer impeller ring.
Figure 4:
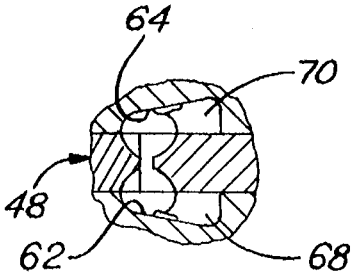
FIG. 4 is an enlarged view of the impeller edge and outer ring, and housing in assembly.

As shown in FIGS. 1 & 3, when the impeller is rotating, fuel is admitted to the channel through an inlet passage 56 in the lower end cap and discharged from the channel through an outlet passage 58 in the upper cap. To prohibit the inlet 56 from directly communicating with the outlet 58, the ring has a dam or block portion 60 disposed between them which, in assembly, extends radially inward to lie closely adjacent the impeller periphery. The actual circumferential location of the inlet 56 and outlet 58 are indicated in phantom in FIG. 3 and for purposes of illustration are shown out of their actual postions in FIG. 1. The pump channel 40 includes annular grooves 62 & 64 in the inlet and outlet caps respectively which extend circumferentially to the inlet 56 and outlet 58 and extend radially over the impeller vanes 52. Preferably, although not necessarily, to improve pump performance, through a portion of the pump channel 40, a rib 66 on the ring extends closely adjacent to the periphery of the impeller and circumferentially at least about half way around the impeller and terminates adjacent the fuel outlet 58. Preferably, although not necessarily, to improve pump performance, generally throughout the circumferentially extent of the rib 66, arcuate grooves 68 & 70 in the caps 44 & 46 extend generally radially inwardly of the annular grooves 62 & 64 in the caps.

For rotating the impeller 38, the armature 20 has a drive shaft 72 projecting from one end thereof which is slidably received in a central hole 74 through the impeller and coupled to the impeller for rotating it by a generally U-shape wire 76 with its bight received in a slot 78 in the shaft and its free ends received in a pair of diametrically opposed holes 80 through the impeller. In operation of the pump, liquid fuel discharged from its outlet 58 flows between the armature 20 and the stator 22 to cool them and through an outlet passage 82 in the end cap housing 16 to supply fuel under pressure to the engine of a vehicle.

Preferably, a check valve 84 biased by a spring 86 is disposed in the outlet 82 to prevent reverse flow of fuel through the outlet to the pump and a pressure relief valve 88 biased by a spring 90 is disposed in a passage 92 through the end cap which, when open, discharges fuel into the vehicle tank or a container therein in which the pump is received. An electric fuel pump as thus far described is disclosed and described in greater detail in U.S. Pat. No. 5,257,916, the disclosure of which is incorporated herein by reference.

In accordance with one feature of this invention, the armature 20 is journalled for rotation in cantilever fashion by its drive shaft 72 being received for rotation in an axial bore 94 or bearing journal through the outlet cap 46 of the pump. Preferably, the outlet cap includes a boss 96 with an end face 98 lying in a plane perpendicular to the axis of the bore 94 and providing a bearing surface on which a complementary face 100 of the armature is received. Preferably, the outlet cap has a circumferentially continuous peripheral shoulder 102 on which the lower end 104 of the stator flux cylinder 24 is slidably received. To align the stator with the armature preferably the shoulder 102 is substantially coaxial with the axis of the shaft 72 and bore 94 and has a relatively close sliding fit with the stator flux cylinder.

In normal operation of the pump, the armature 20 is journalled and mounted for rotation by only the drive shaft 72 being received in the bearing bore 94 of the outlet cap 46. However, to facilitate initial assembly of the components and preferably to provide a positive stop limiting any unusual and grossly excessive lateral displacement of the armature 20, at its other end a stub shaft 106 projects axially beyond the commutator plate 34 and is received in an annular bore or recess 108 in the end cap. At least the portion of the recess 108 overlapping the stub shaft 106 has a minimum inside diameter which is substantially greater than the outside diameter of the stub shaft so that in operation of the pump there is substantial clearance between them to insure that the armature is journalled for rotation only by the bearing bore 94 and drive shaft 72. Typically, the radial clearance between the stub shaft 106 and the housing recess 108 is about 0.015 of an inch per side so that they have a diametrical difference of about 0.030 of an inch.

To limit the axial movement of the armature 20, preferably the end cap housing 16 has an annular depending portion 110 with a flat end face 112 disposed substantially perpendicular to the axis of the bearing bore 94 and lying relatively closely adjacent to but normally spaced from the adjacent end face of the commutator plate 34. Preferably, to minimize noise transmission the bearing face 100 of the armature is yieldably urged into engagement with the end face 98 of the bearing bore 96 by the spring biased brushes 36 of the motor and the mass of the armature 20. Preferaby, when the motor is energized and operating, the armature 20 is axially electromagnetically centered in the stator while the bearing face 100 of the armature engages the end face 98 of the bearing boss.

In accordance with another feature of this invention, the single bearing bore 94 and drive shaft 72 arrangement also mounts and journals for rotation the impeller 38 in the pump housing 42. In operation, the impeller is journalled and rotated by the armature without producing any lateral or side loading in a generally axial direction on the impeller even if the armature drive shaft 72 shifts axially relative to the impeller because the slot 78 and wire 76 drive coupling permits axial movement of the drive shaft.

Typically, in an automotive vehicle, the pump assembly 10 is mounted in a fuel tank so that when the vehicle is on a level horizontal surface, the axis of rotation the motor armature 20 extends vertically substantially perpendicular to the horizontal surface with the armature overlying the pump 12. When the motor is turned off, the armature 20 rests on the bearing surface 98 at the upper end of boss 96 of the outlet cap. In use, when the electric motor is energized to drive the pump, the armature is journalled for rotation in a cantilever fashion by only the portion of the drive shaft 72 received in the bearing bore 94 in the outlet cap. In normal operation of the pump 10 there is a clearance between the stub shaft 106 and the outlet end cap 16 and also clearance between the adjacent faces of the commutator plate 34 and the end face 112 of the outlet cap.

FIGS. 5–8 illustrate another pump assembly 120 embodying this invention with a gear rotor pump 122 driven by an electric motor 14. The electric motor 14, end cap housing 16 and tubular case 18 of this pump assembly 120 are essentially the same as that of the Dump assembly 10, and thus the description of their construction and arrangement will not be repeated.

Figure 5:
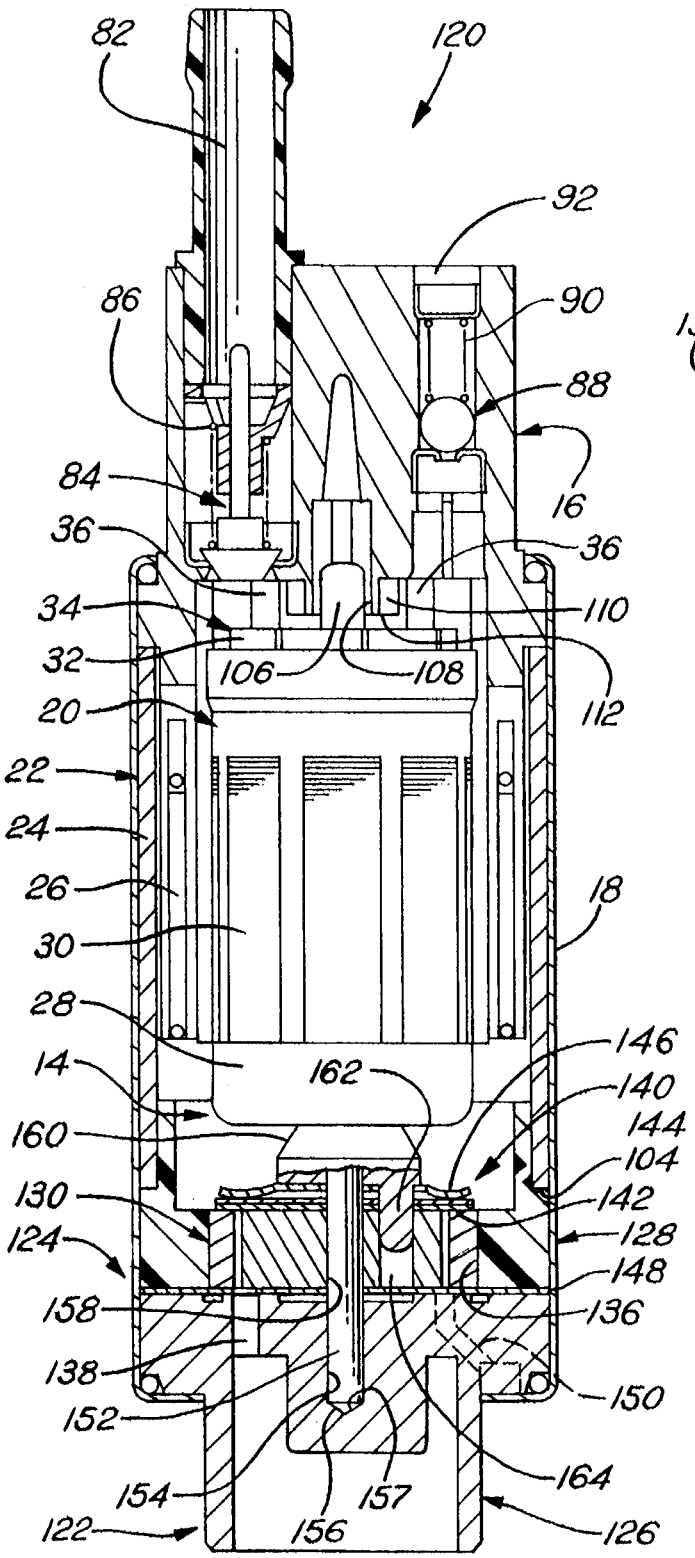
FIG. 5 is a longitudinal section of a modified electric fuel pump with a gear rotor.
Figure 6:
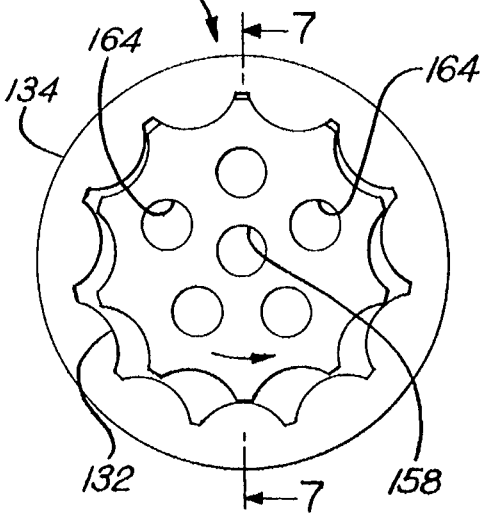
FIG. 6 is an enlarged profile view of the gear-rotor assembly of the pump of FIG. 5.
Figure 7:
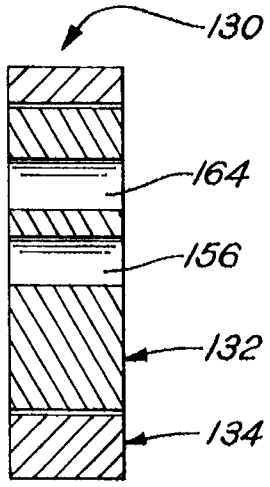
FIG. 7 is a section of the gear rotor taken on line 7–7 of FIG. 6.

The pump 122 has a pump housing 124 with a lower inlet end cap 126 and an upper carrier cap 128 in which a gear-rotor assembly 130 is received. As shown in FIGS. 5 and 6, the rotor assembly 130 has an inner gear element 132 received in an outer gear element 134 which is journalled for rotation in a bore 136 through the carrier housing. When the gear assembly is rotated by the motor, the inner gear 132 is disposed eccentrically relative to the cylindrical periphery of the outer gear ring 134 so that when they are rotated by the motor, the recesses between them enlarge and ensmall to produce a pumping action discharging fuel under pressure from the ensmalling recesses. Fuel is supplied to the enlarging recesses through a fuel inlet 138 in the lower end cap 126 and is discharged from the ensmalling recesses through a flap valve 140 in the form of flexible flat disc 142 underlying a backing disc 144 and yieldably urged into engagement with the upper face of the gear rotor assembly 130 by a spring in the form of a resilient spider element 146. Fuel under pressure discharged through the flap valve 140 passes between the armature 20 and stator 22 of the motor and is discharged through the outlet passage 82 in the end cap housing 16. To provide a low friction wear and sealing surface, a thin flexible disc 148 of metal underlies the gear rotor assembly 130 and is received between the carrier 128 and the lower end cap 126 of the pump housing 124.

Preferably, a vapor purge passage 150 is also provided in the lower end cap 126 which communicates with the recesses when they begin to ensmall to purge gas and fuel vapor from the liquid fuel. A gear rotor fuel pump essentially of this construction as thus far described is disclosed and described in greater detail in U.S. Pat. No. 4,697,995, the disclosure of which is incorporated herein by reference.

In accordance with this invention, the armature 20 is journalled for rotation in a cantilever fashion by its drive shaft 152 being received for rotation in an axial blind bore 154 or bearing journal in the lower end cap 126 of the pump housing. Preferably, the free end of the shaft 152 has a frusto conical surface 156 (or even a planar end face) which bears on a complementary frusto conical (or flat) bearing surface 157 in the end of the bore. In accordance with another feature of this invention, the inner gear element 132 is also located and positioned for rotation in the pump housing 124 by a complementary bore 158 concentric with the axis of the gear element through which the shaft 152 is slidably received.

The inner gear 132 is driven to rotate in unison with the shaft 152 by a hub 160 fixed to the shaft and/or armature 22 and having a depending finger 162 slidably received in a bore 164 through the gear with an axis extending parallel to and radially offset from the axis of the central hole 158 through the inner gear 132. As previously described in connection with the first embodiment 10, preferably, in operation of the pump 120, when the armature 22 is electrically centered axially in the stator 20, the end 156 of the shaft 152 engages its complementary bearing surface 157 in the lower end cap and the commutator plate 34 of the armature 22 is spaced from the end face of the boss 110 of the upper end cap 16. In normal operation, the upper end of the stub shaft 106 is also radially spaced from the recess 108 in the upper end cap 16 so that the armature is journalled while rotating solely by the cantilever shaft 152 and bore 154 or bearing journal arrangement in the lower end cap.

What is claimed is:

1. An electric fuel pump for an engine which comprises, a pump assembly having an end cap housing and a pump housing, an electric motor having a stator in said pump assembly and situated between said housings, an armature received in said stator for rotation relative to said stator, a rotary pump in said pump housing having a rotary element constructed to be driven by said armature, said support shaft being a central drive and support shaft extending axially from one end of said armature, fixed to said armature for rotation in unison therewith and being operably connected with said rotary element for driving it, and a bearing in said pump housing constructed and arranged to journal said shaft of said armature adjacent only one end of said armature and to provide a cantilevered and sole support of said armature when rotating in normal operation when said pump is being driven by the electric motor.

2. A fuel pump as defined in claim 1 in which said pump housing has an inlet portion with a fuel inlet therein and an outlet portion with a fuel outlet therein, said rotary element comprises an impeller, and said rotary pump comprises a ring encircling said impeller and defining in cooperation therewith a pumping channel, said ring and said impeller being received between said inlet portion and said outlet portion, said outlet portion having said bearing receiving said shaft and journaling said armature for rotation.

3. A fuel pump as defined in claim 2 wherein said impeller has about its periphery a plurality of circumferentially spaced apart vanes received in an annular pump channel defined in part by said ring.

4. A fuel pump as defined in claim 2 in which said outlet portion is rigidly supported in said pump assembly.

5. A fuel pump as defined in claim 2 in which said pump assembly includes a tubular case encircling said pump housing, said stator, and said end cap, said tubular case rigidly supporting said pump housing and said stator substantially in coaxial alignment with the axis of rotation of said shaft of said armature.

6. A fuel pump as defined in claim 1 in which said armature has a central stub shaft extending from the other end of said armature, and said end cad has a recess encircling said stub shaft and having a diameter significantly larger than said stub shaft so that in normal operation of the pump, there is signficant clearance between the stub shaft and end caps so that said stub shaft does not bear on said recess.

7. A fuel pump as defined in claim 1 in which said pump housing comprises an inlet cap having a fuel inlet passage therein, an outlet cap having a fuel outlet passage therein, said rotary element comprises an impeller received between said inlet cap and said outlet cap and received on said shaft for journaling said impeller for rotation in unison with said shaft, and said rotary pump comprises a ring received between said inlet cap and said outlet cap, encircling said impeller and defining in cooperation with said impeller, said inlet cap and said outlet cap, an annular pumping channel communicating with both said fuel inlet passage and said fuel outlet passage.

8. A fuel pump as defined in claim 7 in which said outlet cap has said bearing journaling said shaft and supporting said armature and said pump assembly also comprises a tubular casing encircling said inlet cap, outlet cap, stator, and end cap housing and rigidly supporting said outlet cap and said stator in substantially coaxial alignment with the axis of rotation of said shaft of said armature.

9. A fuel pump as defined in claim 1 in which said pump housing comprises an inlet cap having a fuel inlet therein and a carrier cap having a central bore receiving a gear rotor ring therein, a gear rotor ring received in said carrier cap and journalled for rotation therein relative to said carrier cap, said rotary element comprises a gear rotor within said rotor ring and having a central hole through which said shaft of said armature is slidably received, said gear rotor being coupled with said armature for rotation in unison with said shaft, and said inlet cap having said bearing journalling said shaft for rotation and supporting said armature.

10. A fuel pump as defined in claim 9 wherein said carrier cap journals said gear ring for rotation on an axis parallel to and radially spaced from the axis of rotation of said shaft and said gear rotor.

11. A fuel pump as defined in claim 9 in which said pump assembly comprises a tubular casing encircling said inlet cap, carrier cap, and stator and rigidly secures said inlet cap and said stator so that the axis of said stator is substantially coincident with the axis of rotation of said shaft and armature.

12. An electric fuel pump for an engine which comprises, a pump assembly having an end cap housing and a pump housing, an electric motor having a stator in said pump assembly and situated between said housings, and an armature received in said stator for rotation relative to said stator, a rotary pump in said pump housing having a rotary element constructed to be driven by said armature, a central drive and support shaft extending axially from one end of said armature, fixed to said armature for rotation in unison therewith and being operably connected with said rotary element for driving it, and a bearing in said pump housing constructed and arranged to journal said shaft of said armature adjacent only one end of said armature and to provide a cantilevered and sole support of said armature when rotating in normal operation when said pump is being driven by the electric motor so that said armature is not journalled and is not supported other than by said bearing in said pump housing.

* * * * *

UNITED STATES PATENT AND TRADEMARK OFFICE

CERTIFICATE OF CORRECTION

PATENT NO. : 5,525,048

DATED : June 11, 1996

INVENTOR(S) : Charles H. Tuckey

It is certified that error appears in the above-indentified patent and that said Letters Patent is hereby corrected as shown below:

Col. 5, Lines 33-34, after "armature,"
delete "said support shaft being".

Col. 5, Line 35, after "armature,"
insert "said support shaft being".

Signed and Sealed this

Seventeenth Day of September, 1996

*Attest:*

Bruce Lehman

BRUCE LEHMAN

*Attesting Officer*

*Commissioner of Patents and Trademarks*